US006447080B1

(12) United States Patent
Rheault et al.

(10) Patent No.: US 6,447,080 B1
(45) **Date of Patent: *Sep. 10, 2002**

(54) FREESTANDING FURNITURE DEFINING OFFICE WITH ADJUSTABLE FOOTPRINT

(75) Inventors: Alan E. Rheault, Grand Rapids; Mark W. Chamberlin, Delton; Samuel J. Ellison, Wyoming; George J. Simons, Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/226,890

(22) Filed: Jan. 7, 1999

Related U.S. Application Data

(63) Continuation of application No. 08/857,703, filed on May 16, 1997, now Pat. No. 5,947,569.

(51) Int. Cl.[7] ..... A47B 17/00

(52) U.S. Cl. ..... 312/194; 312/205; 312/107

(58) Field of Search ..... 312/107, 108, 312/111, 205, 223.3, 194, 195, 196, 277, 223.6, 317.1, 317.3, 280, 281, 203, 198, 201; 108/50.02, 64, 69, 90, 92, 93, 101, 185; 52/239, 64, 36.1; 160/135

(56) References Cited

U.S. PATENT DOCUMENTS

| | | | | |
|---|---|---|---|---|
| 1,349,710 A | | 8/1920 | Beeson | |
| 1,942,856 A | | 1/1934 | Davis | |
| 2,287,079 A | * | 6/1942 | Anderson | 52/239 |
| 2,614,017 A | | 10/1952 | Mugnier | |
| 2,657,811 A | | 11/1953 | Isler | |
| 2,661,990 A | | 12/1953 | Knuth | |
| 2,744,714 A | | 5/1956 | Parke | |
| 2,821,450 A | | 1/1958 | Knoll | |
| 2,988,413 A | | 6/1961 | Bergen | |
| 3,008,585 A | | 11/1961 | McNeill | |
| 3,049,390 A | | 8/1962 | Wolfe | |
| 3,125,387 A | | 3/1964 | Abrahamson | |
| 3,338,647 A | | 8/1967 | Schreyer | |
| 3,349,528 A | * | 10/1967 | Salt | 52/239 |
| 3,359,930 A | | 12/1967 | Schreyer | |

(List continued on next page.)

FOREIGN PATENT DOCUMENTS

| | | | | |
|---|---|---|---|---|
| EP | 534502 | | 3/1993 | |
| FR | 33471 | * | 9/1928 | 312/201 |

OTHER PUBLICATIONS

Exhibit C is a brochure entitled *Strafor Sevea*, published Dec. 31, 1996, 16 pages.

*Primary Examiner*—Janet M. Wilkens
(74) *Attorney, Agent, or Firm*—Price, Heneveld, Cooper, DeWitt & Litton

(57) ABSTRACT

A telescopingly adjustable furniture article is provided for filling an office space where the footprint dimensions of the office space are not known ahead of time or are likely to be periodically changed to different sizes. The furniture article includes a desk having a worksurface with ends, a support for supporting one of the ends, and a foot on the other end. A storage unit or cabinet having a top is provided. The foot adjustably rests on the top, so that the top supports the other end of the worksurface, but so that the furniture unit is horizontally adjustable to different locations partially under the worksurface. A Z-bracket interconnects the worksurface to the top of the cabinet to secure the relationship of the cabinet and the desk. The furniture article can advantageously be used by itself or in combination with a building wall or demountable architectural wall, or in combination with a partition system to define a plurality of non-uniformly dimensioned offices. The furniture article is further adjustable to optimize use of space in the offices, but while staying within the dimensions of the office space footprints.

23 Claims, 8 Drawing Sheets

U.S. PATENT DOCUMENTS 3,533,362 A 10/1970 Thompson
3,538,976 A * 11/1970 Gilbert ..... 160/135 X
3,648,626 A 3/1972 Schuster
3,698,330 A * 10/1972 Krombach
3,765,344 A 10/1973 Ferdinand et al.
3,979,156 A 9/1976 Gross
4,102,275 A 7/1978 Spound et al.
4,279,453 A 7/1981 Haas
4,323,291 A 4/1982 Ball
4,365,854 A 12/1982 Waller
4,388,783 A * 6/1983 Logie ..... 52/239 X
4,449,762 A 5/1984 Turner
4,559,877 A 12/1985 Waibel
4,600,248 A 7/1986 Pflieger
4,635,418 A * 1/1987 Hobgood ..... 160/135 X
4,639,049 A 1/1987 Frascaroli et al.
4,713,949 A 12/1987 Wilcox
4,731,960 A 3/1988 Sease
4,785,598 A * 11/1988 Stronach ..... 52/239 X
4,821,477 A 4/1989 Rydqvist
4,974,915 A 12/1990 Bussard
5,005,925 A 4/1991 Diehl
5,020,449 A 6/1991 Forte
D327,789 S * 7/1992 Caturla et al. ..... 312/195 X
5,241,796 A 9/1993 Hellwig et al.
5,255,966 A 10/1993 Newhouse et al.
5,309,686 A 5/1994 Underwood et al.
5,394,658 A 3/1995 Schreiner et al.
5,454,636 A 10/1995 Taub
5,513,575 A 5/1996 Slade

* cited by examiner

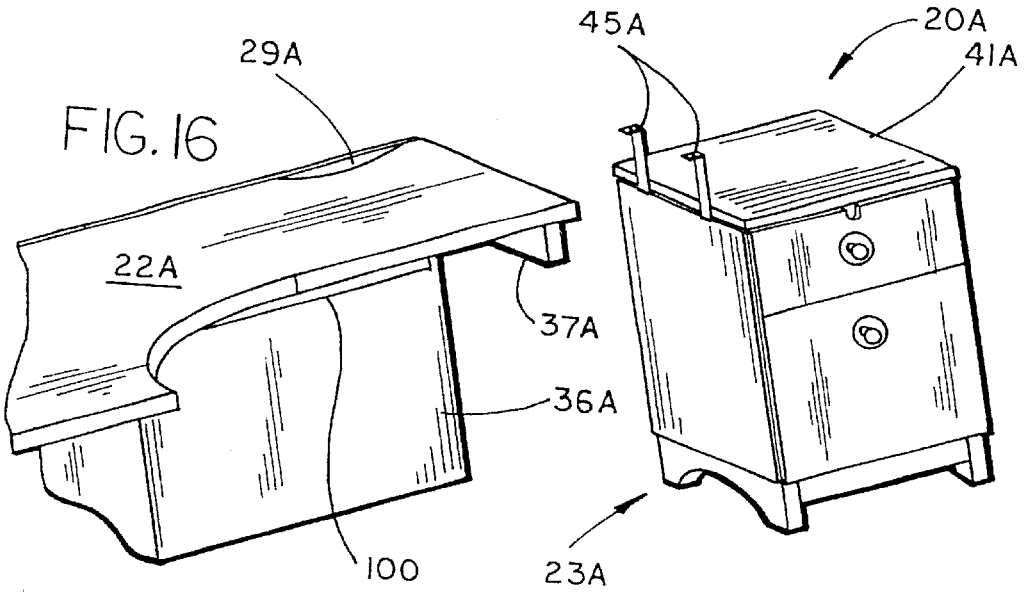
FIG. 16
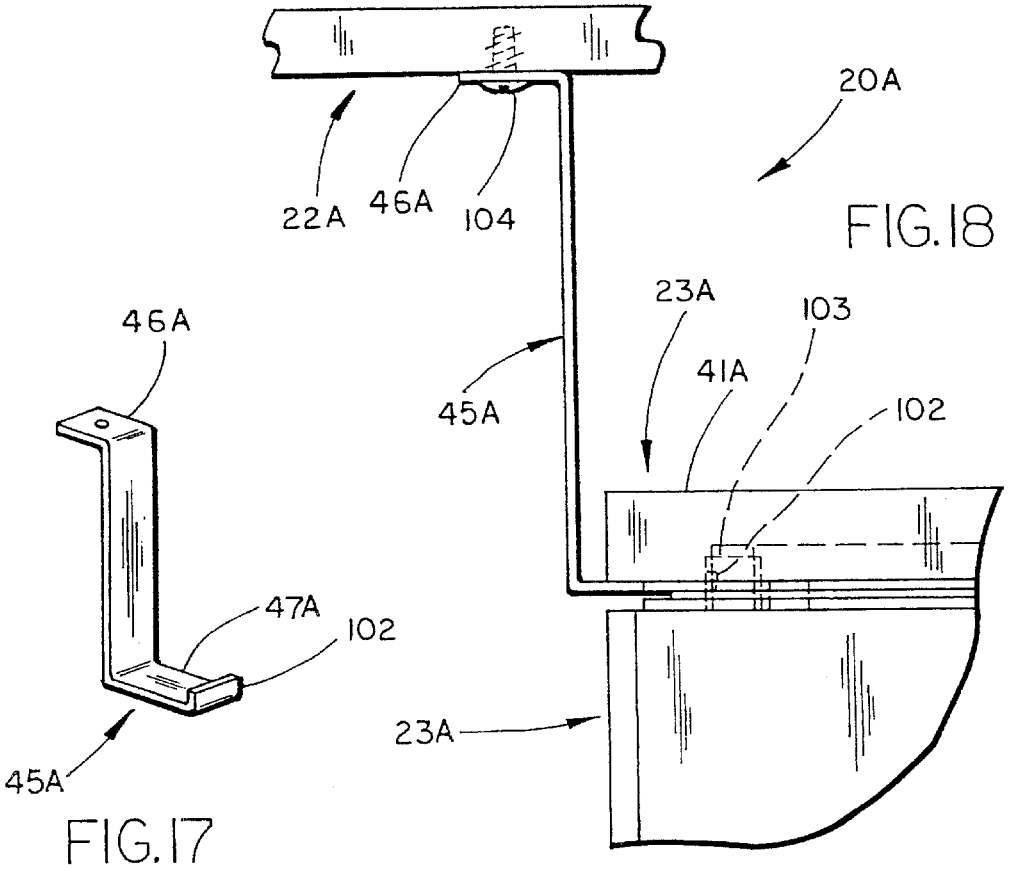
FIG. 18
FIG. 17

FREESTANDING FURNITURE DEFINING OFFICE WITH ADJUSTABLE FOOTPRINT

CROSS-REFERENCE TO RELATED APPLICATION

This is a continuation application of application Ser. No. 08/857,703, filed May 16, 1997, entitled Freestanding Furniture Defining Office with Adjustable Footprint now U.S. Pat. No. 5,947,569.

BACKGROUND OF THE INVENTION

The present invention concerns a furniture system adapted to expand and contract to form offices of different sizes and having different footprints in plan view.

Office space is costly. Also, the organization and layout of office space is very important to job efficiency and job satisfaction. Unfortunately, office needs cannot always be predicted ahead of time, and further the needs change. Thus, there is a tremendous need for a furniture system constructed to expand and contract with the available building space and to provide on-site customized arrangements adaptable to form non-uniform office sizes, but without requiring a huge number of size-specific furniture. Notably, size-specific furniture is common, particularly in wood furniture, such that the inventory of assembled units and also components therefor are often high, expensive, and burdensome.

In order to assure that the furniture on hand fits all offices, many customers order furniture that is small enough to fit into their smallest office or order furniture that most assuredly will fit into their "standard-sized" office, even if the dimensions of a particular "standard-sized" office is slightly off. The result is that many offices have worksurfaces and furniture that leaves a gap near at least one wall of a particular office arrangement. These gaps are unsightly and often collect miscellaneous items until they present an unsightly appearance. At a minimum, the gaps collect dust and debris, since it is difficult to reach into and clean them. Further, such gaps are symptomatic of lost work space. The gaps can also cause frustration in that papers and other items fall off of the worksurfaces into the gaps, where it is difficult to see and/or reach. These problems are aggravated in reconfigurable partition systems, since the partition systems are made to be rearrangeable to form different office arrangements. Where the partition systems permit different sized offices to be constructed, the problem of unsightly and problematic gaps is increased, especially where the partition systems are adapted to allow offices of widely different dimensions to be constructed. Another problem is that, as offices become smaller, there is an increased need for efficient use of space. Every inch of available worksurface space becomes increasingly important. Also, many consumers want to optimize aesthetics when using partition systems, such that there is an increased desire to eliminate any gaps along the partition surfaces defining the offices.

An important part of adjustability in furniture is the ability to expand, as well as contract to fit the available space. When contracting a furniture unit, mars and damage left by attachment bracketry are not usually a problem because they are further hidden as the furniture unit is contracted. However, when a furniture unit is expanded, mars and damage left by attachment bracketry can be problematic, because quite often they become further exposed and more visible. This is particularly true with wood and similar "soft" structural materials that are susceptible to being damaged and is also true for printed or aesthetically covered worksurfaces.

Thus, a furniture system solving the aforementioned needs is desired.

SUMMARY OF THE INVENTION

In one aspect of the present invention, a furniture system includes, in combination, a partition system defining an office area including a pair of opposing partitions defining an internal dimension across the office area; a freestanding first furniture unit positioned against one of the opposing partitions and including a top with a flat top surface; and a freestanding second furniture unit having a worksurface with a floor-supported first end positioned against the other of the opposing partitions, and a second end with a support rested on the top and supporting a weight of the second end of the flat top surface. The first and second furniture units have overlapping sections that are adjustable, so that the first and second furniture units can be positioned to completely fill the internal dimension of the office area, whereby undesirable gaps are eliminated in the office area across the internal dimension.

In another aspect of the present invention, a furniture system includes, in combination, freestanding first and second furniture units including a top and a worksurface, respectively, each providing a flat top surface. The worksurface has a floor-supported first end and a second end with a support rested on the flat top surface of the top. The support is configured to support front and rear corners of the second end. The worksurface is selectively adjustable to different overlapped positions on the top of the first furniture unit, whereby the worksurface can be adjustably supported on the top to an optimum adjusted position, so that the combination completely fills a dimension in an office area and concurrently provides flat surfaces for work or for storing papers completely across the dimension.

In yet another aspect of the present invention, a method includes steps of providing a partition system defining an office area including a pair of opposing partitions defining an internal dimension across the office area; providing a freestanding first furniture unit positioned against one of the opposing partitions and including a top with a flat top surface; providing a freestanding second furniture unit having a worksurface with a floor-supported first end positioned against the other of the opposing partitions, and a second end with a support rested on the top and supporting a weight of the second end on the flat top surface, the first and second furniture units having overlapping sections; and adjusting the first and second furniture units to vary the overlapping sections, so that the first and second furniture units completely fill the internal dimension of the office area, thus eliminating undesirable gaps in the office area across the internal dimension.

These and other features, advantages, and objects of the present invention will be further understood and appreciated by those skilled in the art by reference to the following specification, claims, and appended drawings.

BRIEF DESCRIPTION OF THE DRAWINGS

FIG. 16 is an exploded perspective view showing the furniture article of FIG. 12;

FIG. 17 is a perspective view of the modified attachment bracket shown in FIG. 12;

FIG. 18 is a fragmentary side view showing the attachment bracket of FIG. 17 installed on the furniture article of FIG. 12;

DETAILED DESCRIPTION OF PREFERRED EMBODIMENT

Figure 3:
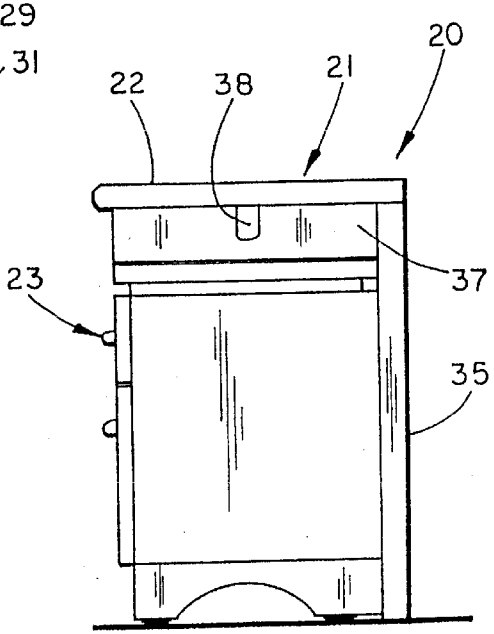
FIG. 3 is an end view of the furniture article shown in FIG. 1.
Figure 1:
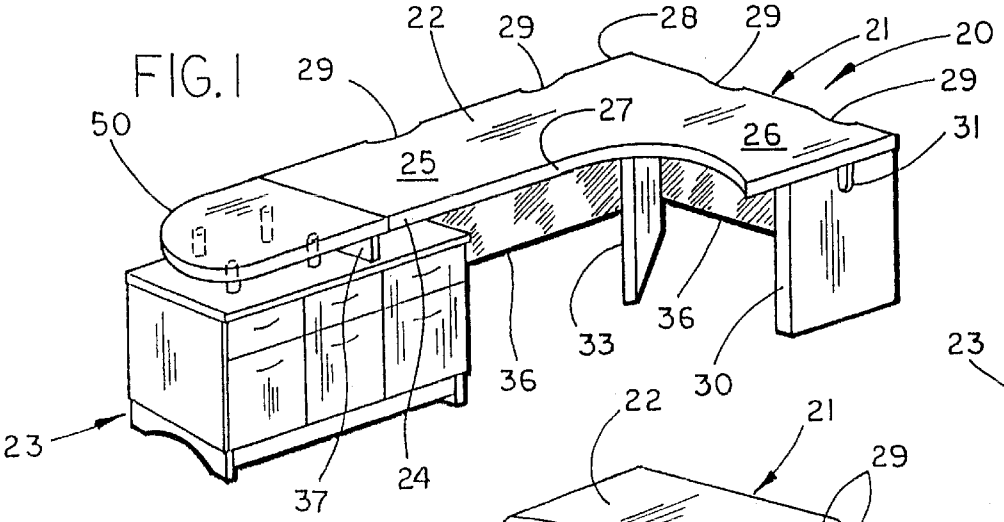
FIG. 1 is a front perspective view of a furniture article embodying the present invention.

Furniture article 20 (FIG. 1) embodying the present invention includes a freestanding desk unit 21 having a worksurface 22, and a low-height storage unit or cabinet 23 supporting one end 24 of the worksurface 22. The cabinet 23 is telescopingly adjustable under the worksurface 22 to various positions. This allows the furniture article 20 to be adjusted to completely fill one side of an office arrangement, even if the dimension of the one side of the office arrangement is not known ahead of time and even if the dimension is changed during rearrangement of the office arrangement. Advantageously, the furniture article 20 can be used to satisfy a plurality of needs, such as maximizing worksurface in a given office arrangement, filling a space within a predetermined office footprint to prevent gaps, providing an optimal appearance, while also eliminating a need for a huge number of size-specific furniture articles. The illustrated article 20 is substantially made of wood products, although the present invention is contemplated to include non-wood furniture and office systems as well.

The worksurface 22 of desk 21 (FIG. 1) is L-shaped and includes a long section 25 and a short section 26 that extends orthogonally to long section 25. The front edge 27 of the worksurface 22 is radiused around its inner corner connecting the long and short sections 25 and 26 to provide an optimal user-friendly shape for use. The rear edge 28 of worksurface 22 includes multiple cutouts 29 for providing vertical wire routing, such as for communication of power to computer equipment when the furniture article 20 is positioned against a wall or partition or other furniture.

Notably, it is contemplated that the present invention will also work on a "straight" rectangular worksurface, and accordingly the shape of the illustrated L-shaped worksurface 22 should not be construed to be unnecessarily limiting.

An end panel or end support 30 is provided at the end of short section 26 for supporting the worksurface 22 on a floor. An aperture 31 is formed at the top of end support 30 to provide for wire routing. A rear corner leg 33 is provided in a rear corner of the joinder of long and short sections 25 and 26.

Figure 2:
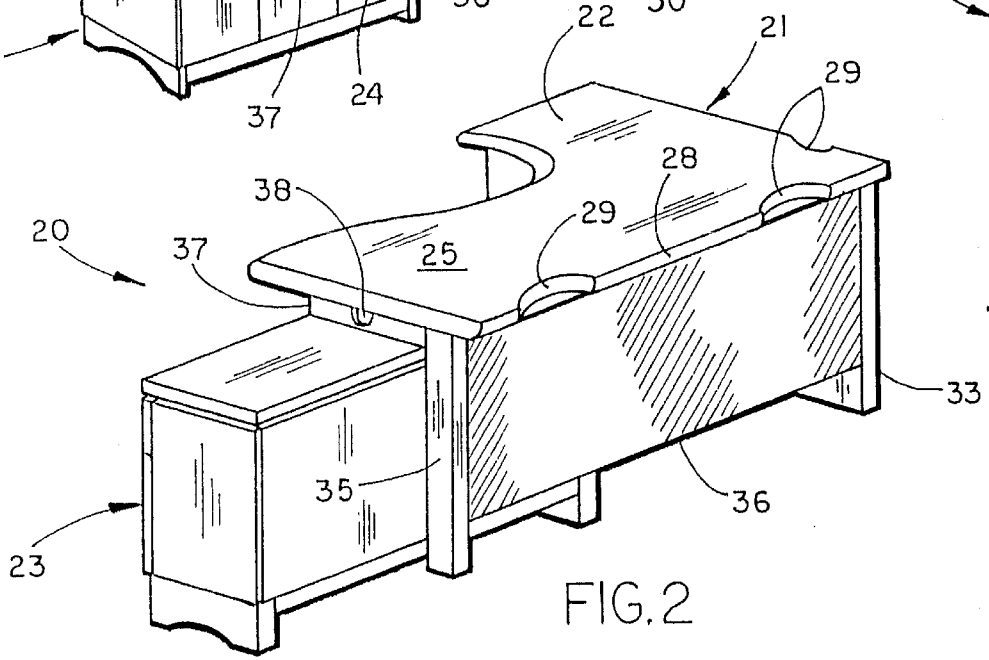
FIG. 2 is a rear perspective view of the furniture article shown in FIG. 1.

Optionally, a second rear leg 35 (FIG. 2) is attached to the end of long section 25 along its rear edge 28. Rear leg 35 supports an optional courtesy panel 36 that extends between corner leg 33 and rear leg 35, and that is located generally under rear edge 28 of long section 25. Rear leg 35 is not required unless the courtesy panel 36 is desired, or unless additional support is required for worksurface 22. A panel-type leg 37 is located under the end of long section 25 generally aligned with rear leg 35. Leg 37 comprises a wood panel that extends generally from a front to a rear of the worksurface 22. An aperture 38 is formed in leg 37 along a top edge thereof for wire routing and for receiving a connector bracket 57 described below.

Figure 4:
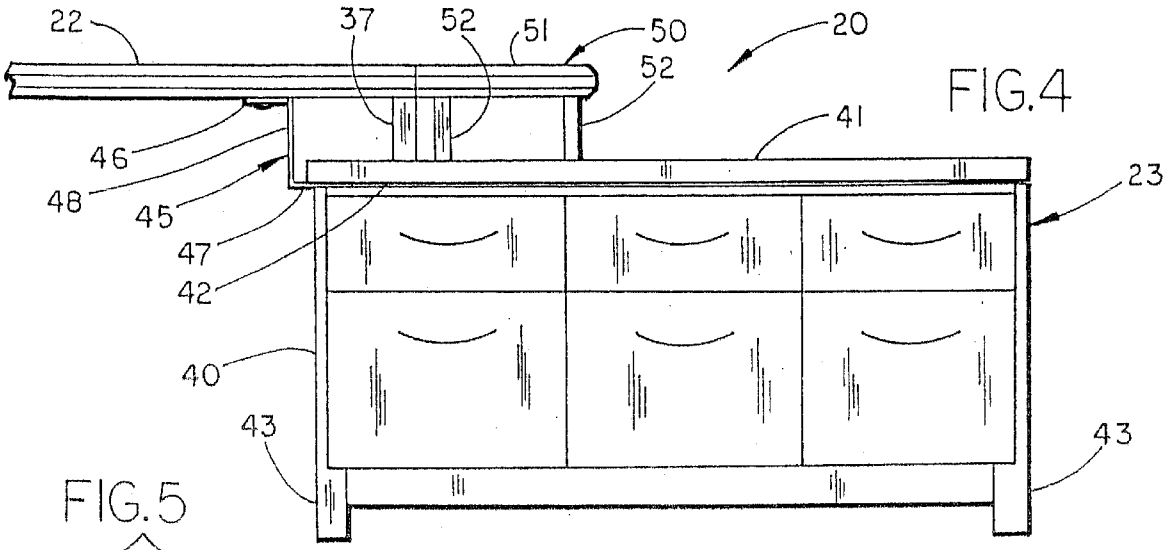
FIG. 4 is a fragmentary front view of the furniture article shown in FIG. 1.
Figure 5:
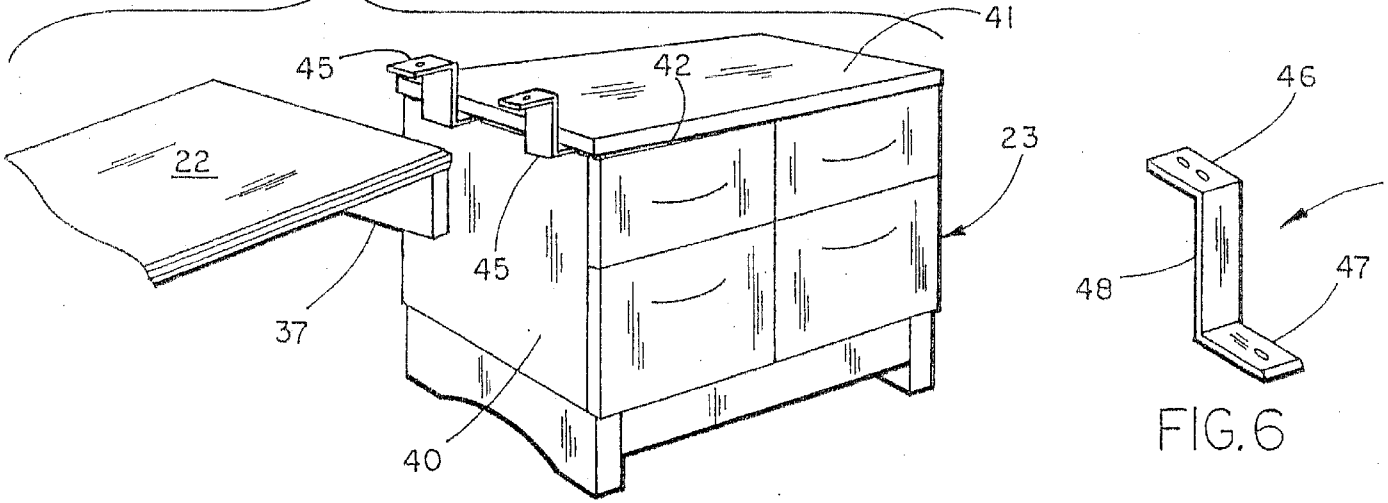
FIG. 5 is a partially exploded view of the furniture article shown in FIG. 1, but wherein the storage unit is a two-wide type storage unit.

Cabinet 23 (FIG. 4) includes a three-drawer wide storage unit 40. Notably, a one or two drawer cabinet or a cabinet with shelves (with or without doors) could also be used. In the illustrated cabinet 23, a top 41 is provided that is spaced above storage unit 40 to create a gap 42 therebetween. Legs 43 extend downwardly from storage unit 40 for supporting the cabinet 23 on a floor surface. Notably, it is contemplated that the present invention include a variety of different furniture units, such as ones having a panel-type flat top. It is also contemplated that the furniture units may or may not include drawers, doors, and other closed storage-type devices.

Figure 6:
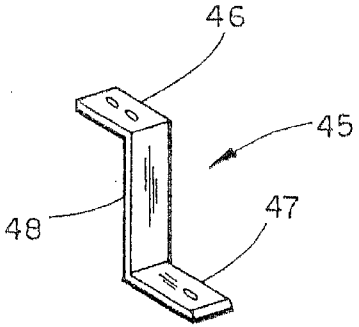
FIG. 6 is a perspective view of the Z-bracket shown in FIG. 4.

A Z-bracket 45 (FIG. 6) is configured to adjustably but fixedly connect desk unit 21 and cabinet 23. The bracket 45 includes a top flange 46 adapted for screw attachment to an underside of the worksurface 22, and further includes a bottom flange 47 configured to extend into the gap 42. Bottom flange 47 includes an aperture so that it can be screw attached to a bottom surface of the top 41. Notably, one or more Z-brackets can be used to connect cabinet 23 to desk 21 as required/desired. A middle section 48 of Z-bracket 45 vertically spaces apart flanges 46 and 47 a predetermined dimension so that the bracket mates with the underside of top 41 of cabinet 23 and with the underside of worksurface 22 of desk 21.

Figure 7:
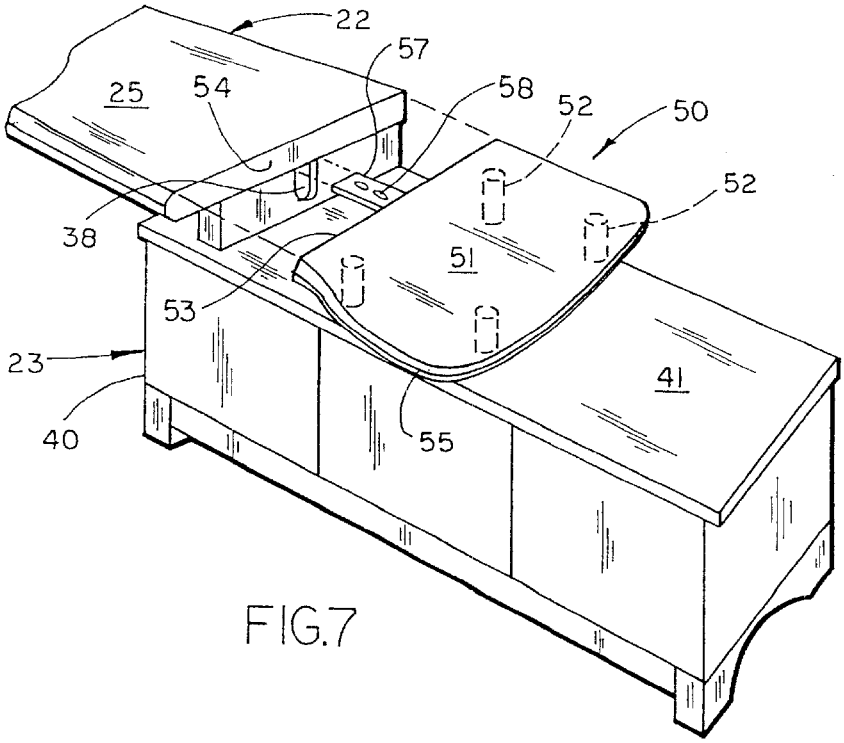
FIG. 7 is an exploded perspective view of the furniture article shown in FIG. 1, including the worksurface extension.

A worksurface extension 50 (FIG. 7) is provided to aesthetically visually terminate the end of the worksurface 22 above cabinet 23. Extension 50 includes a top 51 and multiple legs 52 for supporting the top 51 above cabinet top 41. The legs 52 are spaced apart to stably support the top 51 and align it with the worksurface 22. The top 51 includes an edge 53 configured to matingly abut the end surface 54 of long section 25 of worksurface 22. The remaining perimeter 55 of worksurface extension top 51 is shaped to provide a visually attractive termination of the worksurface 22. A tongue or connector bracket 57 extends from edge 53 and is configured to extend through aperture 38 to an underside of worksurface 22. The connector bracket 57 includes apertures 58 for receiving screws to secure the worksurface extension 50 tightly against worksurface 22. The legs 52 preferably include padded bottom surfaces to minimize scuffing and marring of the cabinet top 41, thus permitting later adjustment without leaving telltale mars.

Figure 8:
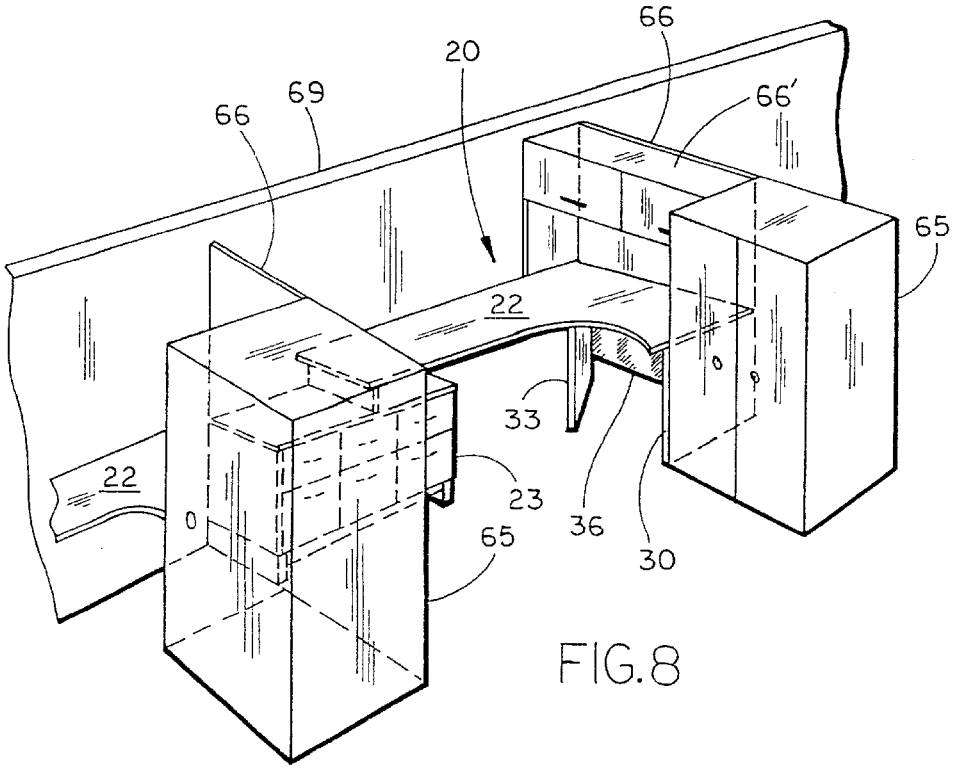
FIG. 8 is a perspective view showing a furniture system incorporating the furniture article shown in FIG. 1, including a screen and a high storage cabinet.

The furniture article 20 can be used as freestanding furniture positioned against a permanent building wall 69 (FIG. 8) or a demountable architectural wall (not shown per se) to define a plurality of offices. As illustrated, a head-high cabinet 65 is positioned adjacent the end of short section 26 to provide visual and physical separation of offices. A screen 66 optionally is attached to a backside of the desk 21, such as to the back of the courtesy panel 36 and extends with the screen 66 extending above worksurface 22. Alternatively, the screen can be attached between the tall cabinet 65 and the building wall 69. Also, FIG. 8 illustrates that a bookbinder, hutch, or other overhead storage unit 66' can be supported on the worksurface to provide visual division of office space.

Figure 9:
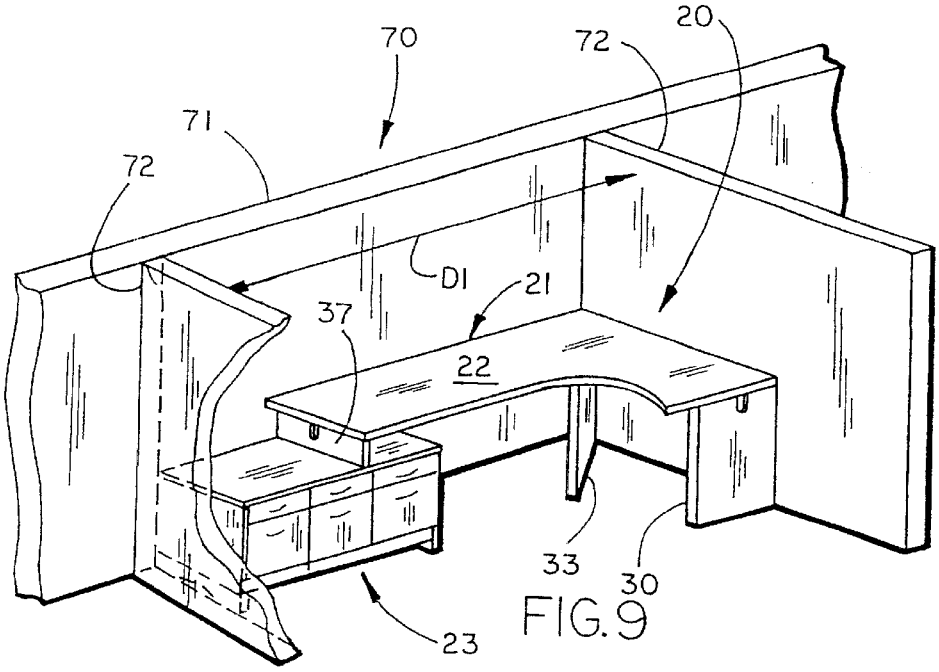
FIG. 9 is a furniture system incorporating the furniture article shown in FIG. 1, including a partition panel system, several of the partition panels being positioned off module and adjustably connected to a main run of partition panel.

In another embodiment, the furniture article 20 is positioned within a building space subdivided into offices by an adjustable partition system 70 (FIG. 9). The partition system 70 is defined in detail in co-assigned U.S. Pat. No. 5,839,240, issued Nov. 24, 1998, entitled Partition Construction and Trim System Therefore, the entire contents of which are incorporated herein by reference.

Partition system 70 need not described herein in detail for a complete understanding of the present invention. Nonetheless, to facilitate a present understanding, it is noted that partition system 70 includes a main run of partitions 71 (called a "spine wall" herein) and also includes off-module position panels 72 (called "fin walls" herein) connected to the main run of panel 71. The fin-wall panels 72 are adjustable to incrementally different positions along the main run of panels 71, such that offices of different dimensional sizes or footprints are possible. The present furniture article 20 is particularly adapted to be positioned within these adjustably sized offices, since the furniture article 20 can be expanded or contracted to completely fill a particular dimension D1 within the adjustable offices, even where the dimension is not known ahead of time or where the dimension may change during office rearrangement. Thus, the furniture article 20 eliminates any undesired gaps or "rats nests" within the adjustable offices.

Figure 10:
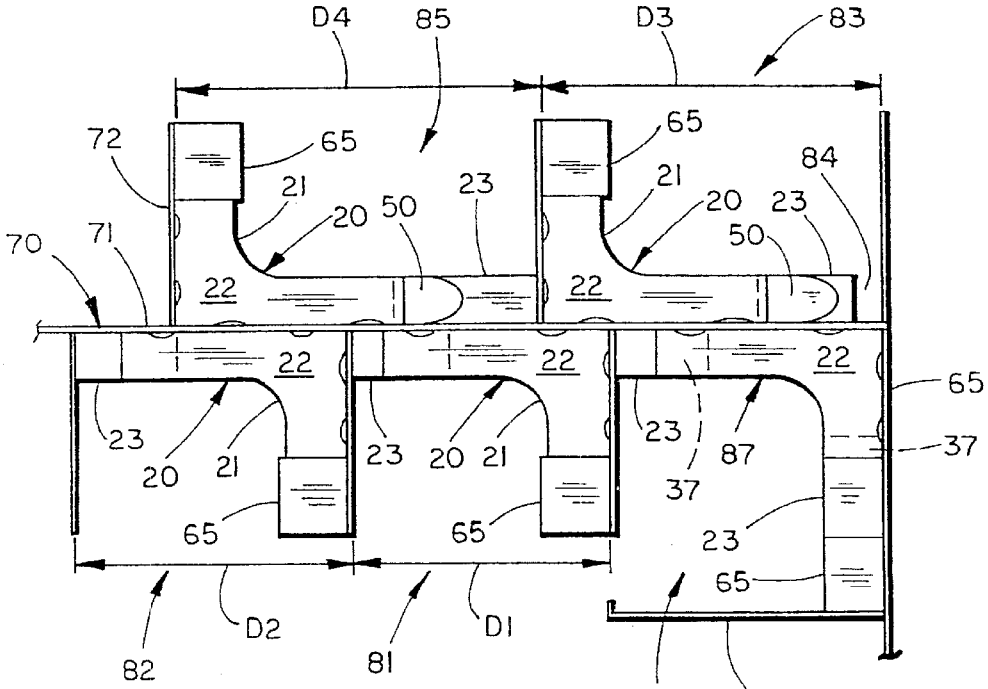
FIG. 10 is a schematic plan view of the furniture system shown in FIG. 9, the illustrated office arrangement including five differently sized offices.

FIG. 10 is an example showing five offices, each with a different dimension. Notably, in FIG. 10, the furniture articles shown include a first office 81 with a furniture article 20 having a desk 21 and a two-drawer cabinet 23A for completely filling one side having a first dimension D1. FIG. 10 further illustrates a second office 82 having a furniture article 20 with a two-drawer cabinet 23 adjusted under the desk 21 to a dimension D2 that is larger than dimension D1. Also illustrated is an office 83 having a furniture article 20 utilizing a two-drawer cabinet 23 and positioned to define a predetermined corner space 84 for receiving materials for storage (e.g. rolled drawings or the like). Also shown is a fourth office 85 with a furniture article 20 which utilizes a three-drawer cabinet 23 and a worksurface extension 50. This last office defines a dimension D4 that is considerably larger than DI and D2 and somewhat larger than dimension D3. A fifth office 86 is shown having a furniture article 87 that is adjustable in two directions, as described below.

Figure 11:
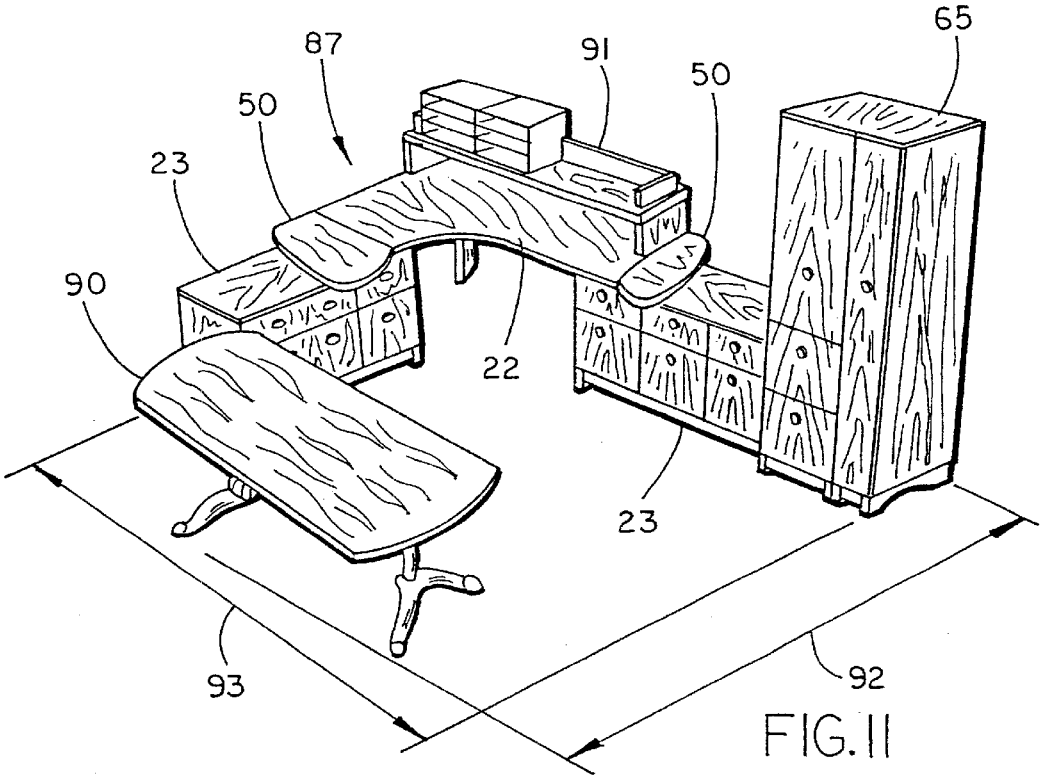
FIG. 11 is a perspective view showing the furniture system of FIG. 1 incorporated into a stand-alone office that is adjustable in size orthogonal directions.
Figure 12:
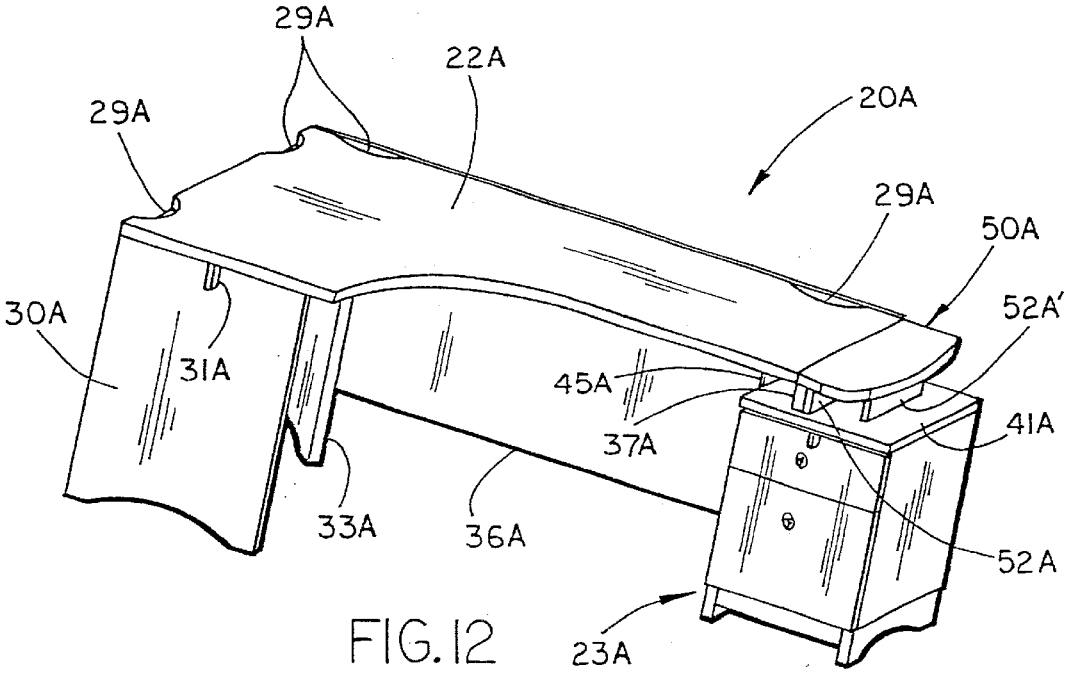
FIG. 12 is a front perspective view showing a modified furniture article embodying the present invention.
Figure 13:
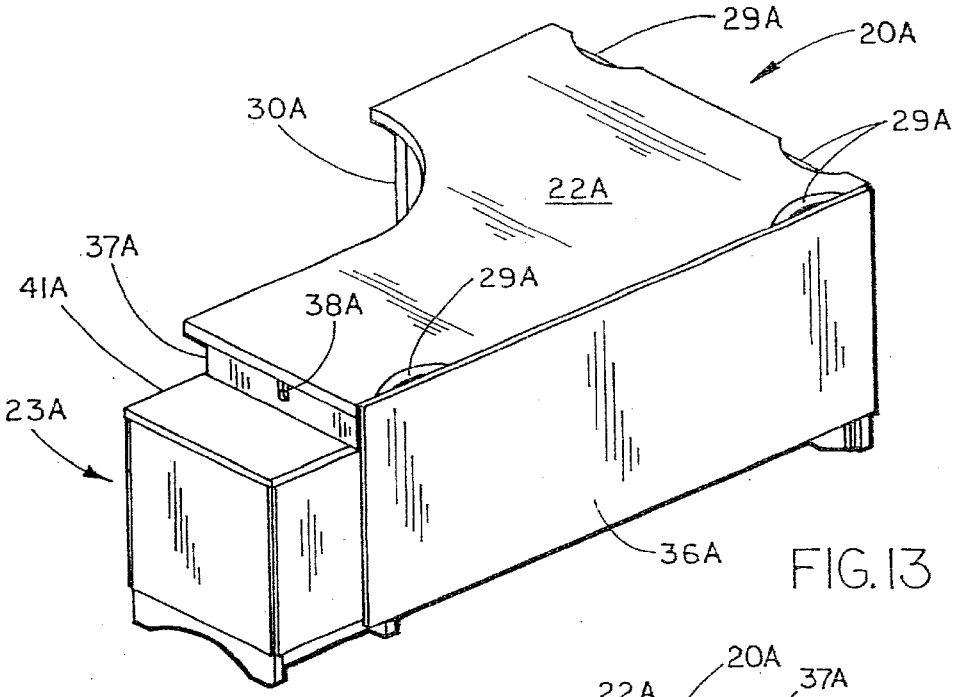
FIG. 13 is a rear perspective view showing the modified furniture article of FIG. 12.
Figure 14:
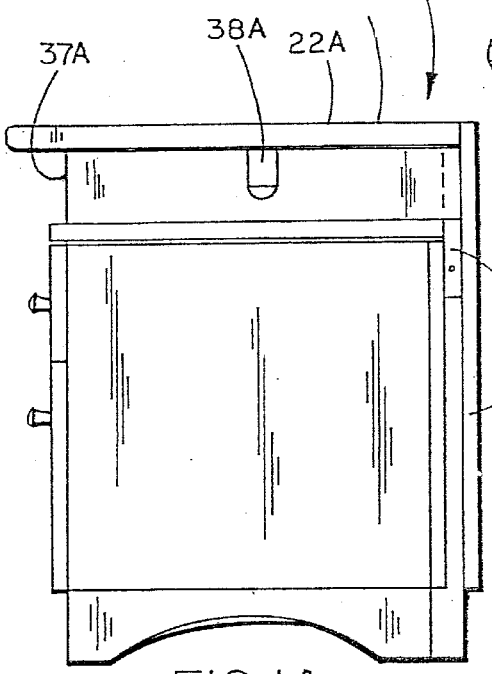
FIG. 14 is an end view of the furniture article shown in FIG. 12.

Furniture article 87 (FIG. 11) includes identical or similar components to furniture article 20, and identical identification numbers are used to reduce redundant discussion. Basically, in furniture article 87, the end support 30 is eliminated and a second cabinet 23 is used in combination with a second foot 37 and second bracket 45, to support short section 26 of worksurface 22. A table 90 and topmounted bookcase/shelf 91 finish the office to dimensions 92 and 93.

Figure 15:
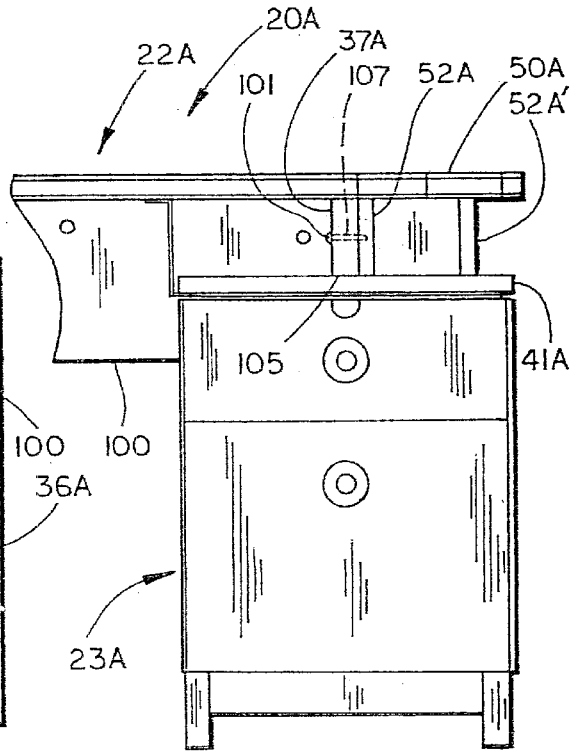
FIG. 15 is a front view showing the furniture article of FIG. 12.
Figure 19:
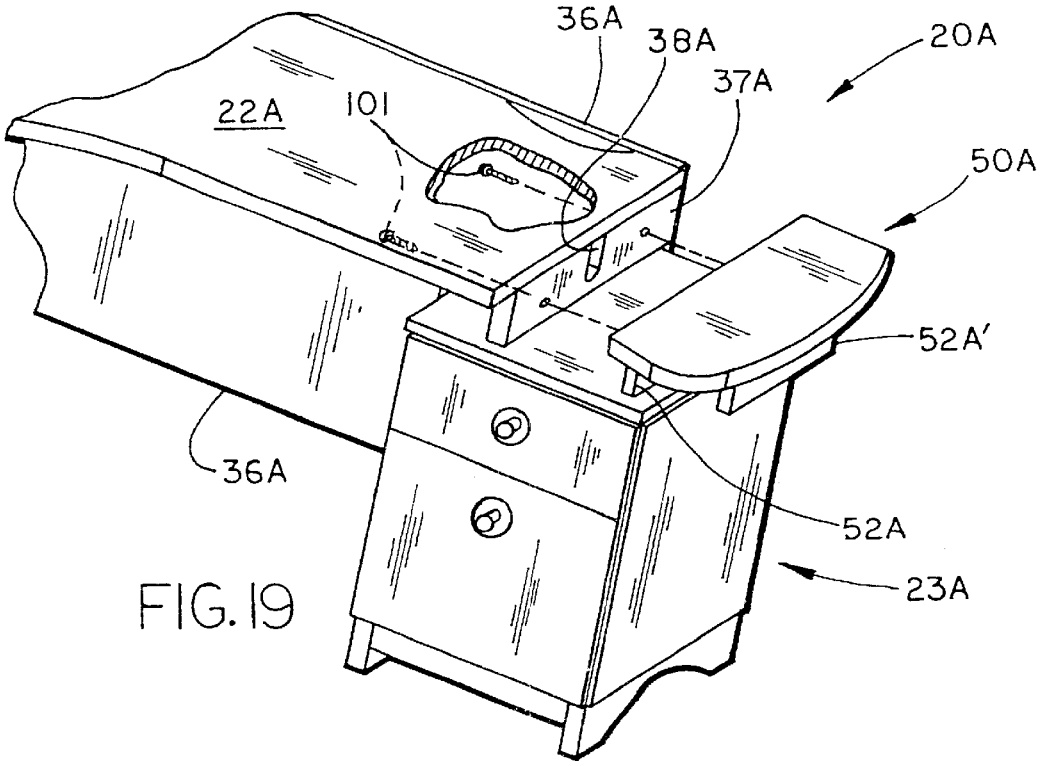
FIG. 19 is an exploded fragmentary perspective view of the furniture article shown in FIG. 12.
Figure 20:
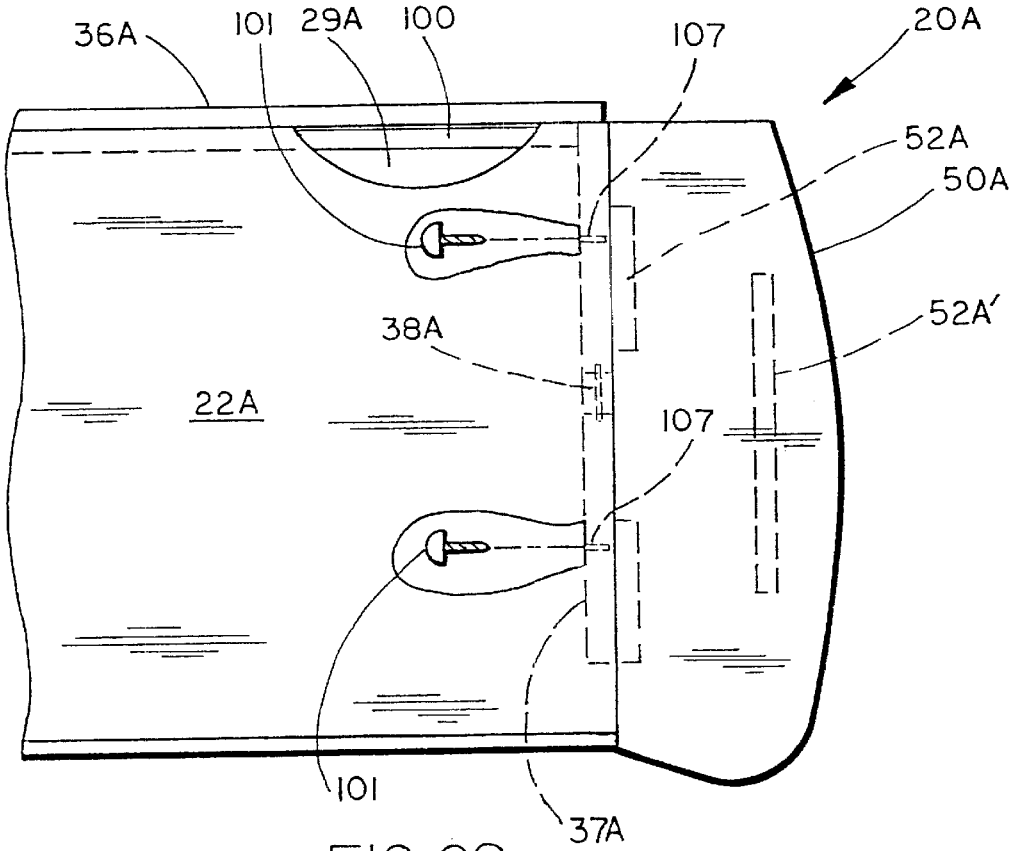
FIG. 20 is a partially exploded fragmentary top view of the furniture article shown in FIG. 12.

A modified furniture article 20A is illustrated in FIGS. 12–20. In modified furniture article 20A, all features and components that are identical or similar to the furniture article 20 are identified with identical numbers, but with the additional letter "A." For example, the furniture article 20A includes cutouts 29A, an end support 30A, an aperture 31A, a corner leg 33A, and an aperture 38A. In furniture article 20A, the rear leg 35 (FIG. 2) has been eliminated. An inner back panel 100 (FIGS. 14 and 15) is attached to worksurface 22A and is attached to an inside of the leg 37A. The inner back panel 100 is about twice the height of leg 37A and extends below leg 37A. Inner back panel 100 engages a back end of the cabinet 23A and acts as a stop to accurately position the cabinet 23A under the worksurface 22A. Further, the inner back panel 100 provides a mounting surface for attachment of the optional courtesy panel 36A. The worksurface extension 50A includes a first panel leg 52A and a second panel leg 52A' (FIG. 15). Panel leg 52A is located adjacent leg 37A and is attached thereto by screws 101 (FIG. 19). Bracket 45A (FIGS. 17 and 18) includes a lower leg 47A having a lip 102 configured to engage a recess 103 in the bottom surface of top 41A of cabinet 23A. The upper end 46A screw attaches to the underside of the worksurface 22A using a screw 104. The bracket 45A is configured so that when it is attached, it draws the worksurface 22A downwardly, thus compressing leg 37A (FIG. 15). The leg 37A includes a rubber pad or shoe 105 (or other non-abrasive material, such as felt or soft plastic) on its bottom to prevent marring of the cabinet top 41A. Further, the rubber shoe 105 provides a relatively high coefficient of friction to prevent inadvertent movement of the cabinet 23A relative to the worksurface 22A. It is noted that the screws 101 go to holes 107 in leg 37A. The holes 107 (FIG. 20) are predrilled but do not pierce the outer surface of the leg 37A, such that the furniture article 20A can be used without the worksurface extension 50A (FIG. 20). When a screw 101 is used, it pierces the end of the hole 107 and extends into leg 52A.

Accordingly, a telescopingly adjustable furniture system is provided, including furniture articles configured to adjustably fill an office space where the footprint dimensions of the office space are not known ahead of time, or where the office space is likely to be periodically adjusted in size. The furniture system includes a plurality of freestanding desks and cabinets that can be telescopingly adjusted relative to each other and that can be used in combination with other space-dividing furniture, such as tall cabinets and screens, permanent building walls, or partitions. In particular, the present furniture article is particularly useful in combination with partition systems having thin-wall partitions adjustably attached to other partitions and reconfigurable to form offices of different sizes.

The above description is considered that of the preferred embodiment(s) only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A furniture system comprising, in combination:

a partition system defining an office area including a freestanding spine wall and first and second opposing freestanding partitions connected to the spine wall and defining an adjustable internal dimension across the office area, the first and second partitions each being releasably and adjustably connected to the spine wall, such that the internal dimension can be changed by moving the first partition relative to the spine wall, and by moving the second partition relative to the spine wall;

a freestanding first furniture unit positioned against one of the opposing partitions and including a top with a first flat top surface; and a freestanding second furniture unit having a worksurface with a floor-supported first end positioned against the other of the opposing partitions and a second end with a support rested on the top of the first furniture unit and supporting the weight of the second end of the second furniture unit on the flat top surface of the first furniture unit, the first and second furniture units having overlapping sections that are adjustable, so that the first and second furniture units can be positioned to completely fill the internal dimension of the office area, whereby undesirable gaps are eliminated in the office area across the internal dimension.

2. The furniture system defined in claim 1, wherein the support comprises a leg extending from the worksurface and engaging the first flat top surface to support the weight of the second end of the worksurface on the first flat top surface.

3. The furniture system defined in claim 2, wherein the entire weight of the second end of the worksurface is transmitted to the first furniture unit.

4. The furniture system defined in claim 3, wherein the leg includes a material that is resistant to marring and damaging the first flat top surface, even though the material engages the first flat top surface.

5. The furniture system defined in claim 4, wherein the first furniture unit includes a wood top panel that forms the first flat top surface.

6. The furniture system defined in claim 4, wherein the material comprises a frictional material that creates a high friction on the first flat top surface that is resistant to sliding on the first flat top surface.

7. The furniture system defined in claim 6, wherein the frictional material comprises rubber.

8. The furniture system defined in claim 4, wherein the material comprises felt.

9. The furniture system defined in claim 4, wherein the material comprises a relatively soft polymeric material.

10. The furniture system defined in claim 2, wherein the leg comprises an elongated panel that extends from a front toward a rear of the worksurface and that includes an aperture for routing utilities through the elongated panel.

11. The furniture system defined in claim 1, wherein the support includes front and rear portions that support front and rear corner of the second end.

12. The furniture system defined in claim 1, wherein the support supports the worksurface above the first flat top surface a predetermined distance, and wherein the support includes an aperture adapting the support to allow utilities to be routed through the aperture in the support.

13. A furniture system comprising, in combination:

a partition system defining an office area including a freestanding spine wall and first and second opposing freestanding partitions connected to the spine wall and defining an adjustable internal dimension across the office area, the first and second partitions each being releasably and adjustably connected to the spine wall, such that the internal dimension can be changed by moving the first partition relative to the spine wall, and by moving the second partition relative to the spine wall;

a freestanding first furniture unit positioned against one of the opposing partitions and including a top with a first flat top surface;

a freestanding second furniture unit having a worksurface with a floor-supported first end positioned against the other of the opposing partitions and a second end with a support rested on the top of the first furniture unit and supporting the weight of the second end of the second furniture unit on the flat top surface of the first furniture unit, the first and second furniture units baying overlapping sections that are adjustable, so that the first and second furniture units can be positioned to completely fill the internal dimension of the office area, whereby undesirable gaps are eliminated in the office area across the internal dimension;

wherein the support supports the worksurface above the first flat top surface a predetermined distance, and wherein the support includes an aperture adapting the support to allow utilities to be routed through the aperture in the support; and including a worksurface extension having legs that support the extension on the first flat top surface, with a flat top surface of the extension being coplanar with a flat top of the worksurface.

14. A furniture system comprising, in combination:

freestanding first and second furniture units including a top and a worksurface, respectively, each providing a flat top surface, the worksurface having a floor-supported first end and a second end with a support rested on the flat top surface of the top, the support being configured to support front and rear corners of the second end, the support including a pad of mar resistant material contacting the flat top surface of the top, the pad fixed to the support in a substantially non-movable manner, the worksurface being selectively adjustable to different overlapped positions on the top of the first furniture unit, whereby the worksurface can be adjustably supported on the top to an optimum adjusted position so that the combination completely fills a dimension in an office area and concurrently provides flat surfaces for work or for storing papers completely across the dimension.

15. The furniture system defined in claim 14, wherein the support comprises a leg extending from the worksurface and engaging the flat top surface of the top to support a weight of the second end of the worksurface on the top.

16. The furniture system defined in claim 15, wherein the entire weight of the second end of the worksurface is transmitted to the first furniture unit.

17. A furniture system comprising, in combination:

freestanding first and second furniture units including a top and a worksurface, respectively, each providing a flat top surface, the worksurface having a floor-supported first end and a second end with a support rested on the flat top surface of the top, the support being configured to support front and rear corners of the second end, the worksurface being selectively adjustable to different overlapped positions on the top of the first furniture unit, whereby the worksurface can be adjustably supported on the top to an optimum adjusted position so that the combination completely fills a dimension in an office area and concurrently provides flat surfaces for work or for storing papers completely across the dimension;

wherein the support comprises a leg extending from the worksurface and engaging the flat top surface of the top to support a weight of the second end of the worksurface on the top; and wherein the leg defines a lower end, said leg including a pad fixed to said lower end.

18. The furniture system defined in claim 17, wherein said pad comprises a frictional material that creates a high friction on the flat top surface of the first furniture unit that is resistant to sliding on the flat top surface of the first furniture unit.

19. The furniture system defined in claim 17, wherein said pad comprises a relatively soft polymeric material.

20. The furniture system defined in claim 14, including a partition system defining the office area, the partition system including a pair of opposing partitions defining the dimension in the office area, the top of the first furniture unit being positioned against one of the opposing partitions and the worksurface of the second furniture unit being positioned against the other of the opposing partitions.

21. A method comprising steps of:

providing a partition system defining an office area including a spine wall and opposing first and second partitions, each adjustably connected to the spine wall and defining an internal dimension across the office area;

adjusting the position of the first partition relative to the spine wall to adjust the internal dimension;

adjusting the position of the second partition relative to the spine wall to adjust the internal dimension;

providing a freestanding first furniture unit positioned against one of the opposing partitions and including a top with a flat top surface;

providing a freestanding second furniture unit having a worksurface with a floor-supported first end positioned against the other of the opposing partitions and a second end with a support rested on the top and supporting a weight of the second end on the flat top surface, the first and second furniture units having overlapping sections; and adjusting the first and second furniture units to vary the overlapping sections, so that the first and second furniture units completely fill the internal dimension of the office area, thus eliminating undesirable gaps in the office area across the internal dimension.

22. A furniture system comprising, in combination:

a freestanding reconfigurable partition system defining an office area and including a pair of spaced-apart partitions, each of which is movable relative to the other to define an adjustable internal dimension, said partitions having a lower portion configured to abuttingly support said partitions freestanding on a floor surface;

a freestanding first furniture unit positioned against a selected one of the partitions, said first furniture unit supported solely by the floor surface without structural interconnection to the selected one of the partitions;

a freestanding second furniture unit having a worksurface with a floor-supported first end positioned against the other of the opposing partitions without structural interconnection therewith, said second furniture unit having a second end adjustably interconnected with said first furniture unit and permitting relative movement between the first and second furniture units in a manner that changes an overall dimension defined by the first and second furniture units to completely fill the internal dimension of the office area.

23. A furniture system comprising, in combination:

a partition system defining at least a pair of office areas, said partition system including a freestanding spine wall and first and second opposing freestanding partitions connected to a first side of the spine wall to define a first office area and third and fourth opposing partitions connected to an opposite side of the spine wall to define a second office area, said partitions defining adjustable internal dimensions across the office areas, each partition being releasably and adjustably connected to the spine wall, such that the internal dimensions can be changed by moving each partition relative to the spine wall;

a first furniture assembly, positioned in said first office area and including first and second freestanding furniture units;

said freestanding first furniture unit positioned against one of the opposing partitions and including a top with a first flat top surface;

said freestanding second furniture unit having a worksurface with a floor-supported first end positioned against the other of the opposing partitions and a second end with a support rested on the top of the first furniture unit and supporting the weight of the second end of the second furniture unit on the flat top surface of the first furniture unit, the first and second furniture units having overlapping sections that are adjustable, so that the first and second furniture units can be positioned to completely fill the internal dimension of the office area, whereby undesirable gaps are eliminated in the office area across the internal dimension; and a second furniture assembly substantially identical to said first furniture assembly and positioned in said second office area on said opposite side of said spine wall.

* * * * *